US009321274B2

(12) United States Patent
Takagi et al.

(10) Patent No.: US 9,321,274 B2
(45) Date of Patent: Apr. 26, 2016

(54) LIQUID EJECTION CARTRIDGE AND LIQUID EJECTION APPARATUS

(71) Applicant: CANON KABUSHIKI KAISHA, Tokyo (JP)

(72) Inventors: Yosuke Takagi, Yokohama (JP); Kiyomitsu Kudo, Machida (JP); Yuichiro Akama, Tokyo (JP); Satoshi Kimura, Kawasaki (JP); Tomotsugu Kuroda, Yokohama (JP); Kyosuke Toda, Kawasaki (JP); Naoko Tsujiuchi, Kawasaki (JP); Sayaka Seki, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/702,305

(22) Filed: May 1, 2015

(65) Prior Publication Data

US 2015/0343791 A1 Dec. 3, 2015

(30) Foreign Application Priority Data

May 30, 2014 (JP) ..... 2014-112192

(51) Int. Cl.
*B41J 2/175* (2006.01)
*B41J 2/14* (2006.01)

(52) U.S. Cl.
CPC ..... *B41J 2/17526* (2013.01)

(58) Field of Classification Search
CPC .... B41J 2/17503; B41J 2/1752; B41J 2/1753; B41J 2/17523; B41J 2/17546; B41J 2/17553; B41J 2/17559; B41J 2/17526
USPC ..... 347/49, 50, 86
See application file for complete search history.

(56) References Cited

U.S. PATENT DOCUMENTS

| | | | | |
|---|---|---|---|---|
| 5,748,210 | A * | 5/1998 | Watanabe | B41J 2/1752 347/50 |
| 6,120,140 | A | 9/2000 | Hirosawa et al. | 347/93 |
| 6,170,940 | B1 * | 1/2001 | Shinada | B41J 2/1752 347/86 |
| 6,227,643 | B1 * | 5/2001 | Purcell | B41J 2/01 347/14 |
| 6,247,806 | B1 | 6/2001 | Matsumoto et al. | 347/87 |
| 6,302,535 | B1 * | 10/2001 | Sturgeon | B41J 2/17503 347/86 |
| 6,361,138 | B1 * | 3/2002 | Seino | B41J 2/16532 347/19 |
| 6,505,915 | B2 | 1/2003 | Asakawa et al. | 347/65 |
| 6,631,967 | B1 * | 10/2003 | Saruta | G06K 15/102 347/19 |
| 6,659,591 | B2 * | 12/2003 | Sato | B41J 2/14024 347/50 |
| 6,827,430 | B2 | 12/2004 | Tsujimoto et al. | 347/85 |
| 6,840,610 | B2 | 1/2005 | Taniguchi et al. | 347/86 |
| 7,556,366 | B2 | 7/2009 | Kudo et al. | 347/86 |

FOREIGN PATENT DOCUMENTS

JP 2004/358912 12/2004

* cited by examiner

*Primary Examiner* — Anh T. N. Vo
(74) *Attorney, Agent, or Firm* — Fitzpatrick, Cella, Harper & Scinto

(57) ABSTRACT

A liquid ejection cartridge having a liquid ejection section for ejecting liquid includes an electrical contact section to be electrically connected to a terminal section of an apparatus main body, the electrical contact section being formed by a plurality of printed substrates arranged on a same surface.

20 Claims, 5 Drawing Sheets

LIQUID EJECTION CARTRIDGE AND LIQUID EJECTION APPARATUS

BACKGROUND OF THE INVENTION

1. Field of the Invention

The present invention relates to a liquid ejection cartridge to be used in a liquid ejection apparatus for forming an image on a recording medium such as a sheet of paper by ejecting liquid.

2. Description of the Related Art

In inkjet type recording apparatus for recording images on recording mediums (to be referred to as liquid ejection apparatus hereinafter), a liquid ejection head for ejecting liquid such as ink is driven to eject liquid droplets so as to make them hit a recording medium at respective target positions and form an image thereon.

Liquid ejection apparatus include those that are mounted by a liquid ejection cartridge that is by turn equipped with a liquid ejection head. The liquid ejection head has an electrical contact section and the liquid ejection head is electrically connected to the apparatus main body as the electrical contact section is brought into contact with the electrical connector pins of the apparatus main body. Driving signals, signals that indicate the remaining quantity of ink and other signals are exchanged between the apparatus main body and the liquid ejection head.

The electrical contact sections of liquid ejection cartridges include those that are structurally referred to as "substrate type" and those that are structurally referred to as "film type". A "substrate type" electrical contact section has contact pads that are typically made of gold and formed on a printed substrate, which is made of glass epoxy or the like. A "film type" electrical contact section, on the other hand, has contact pads that are typically made of gold and formed on a flexible wiring film. "Substrate type" electrical contact sections are expensive if compared with "film type" electrical contact sections but are being currently broadly employed because they are highly reliable.

Japanese Patent Application Laid-Open No. 2004-358912 describes a head cartridge that is equipped with a "substrate type" electrical contact section. The head cartridge is so designed as to be fitted to the carriage of a liquid ejection apparatus main body and has an electrical contact section formed on the surface thereof to be located vis-à-vis the surface of the carriage where electrical connector pins are formed. The electrical contact section includes a plurality of contact pads by way of which drive signals, signals that indicate the remaining quantity of ink and other signals are transmitted. The contact pads are formed on a single printed substrate.

When manufacturing printed substrates, ordinarily, substrates having a predetermined size are cut to produce printed substrates exactly representing a required size. The unit cost of printed substrates is reduced as the number of printed substrates produced from a single substrate is increased, in other words, as the size of each printed substrate is reduced.

Because the electrical contact section of the head cartridge described in Japanese Patent Application Laid-Open No. 2004-358912 for electrically connecting the cartridge with the carriage is formed on a single printed substrate, the printed substrate is inevitably required to have a large size. For this reason, the unit cost of the printed substrate is high to in turn raise the cost of the head cartridge.

SUMMARY OF THE INVENTION

An object of the present invention is to provide a liquid ejection cartridge having a liquid ejection section for ejecting liquid, the cartridge including: an electrical contact section to be electrically connected to a terminal section of an apparatus main body; the electrical contact section being formed by a plurality of printed substrates arranged on a same surface.

Another object of the present invention is to provide a liquid ejection cartridge including: a cabinet; a recording element substrate arranged on a first surface of the cabinet to eject liquid; a container section for containing a liquid tank to contain liquid therein; a connector arranged in the container section; a first electrical wiring substrate arranged on a second surface of the cabinet so as to be electrically connected to the recording element substrate; and a second electrical wiring substrate arranged on the second surface so as to be electrically connected to the connector.

Further features of the present invention will become apparent from the following description of exemplary embodiments with reference to the attached drawings.

DESCRIPTION OF THE EMBODIMENTS

Now, an embodiment of the present invention will be described below by referring to the accompanying drawings.

Figure 1:
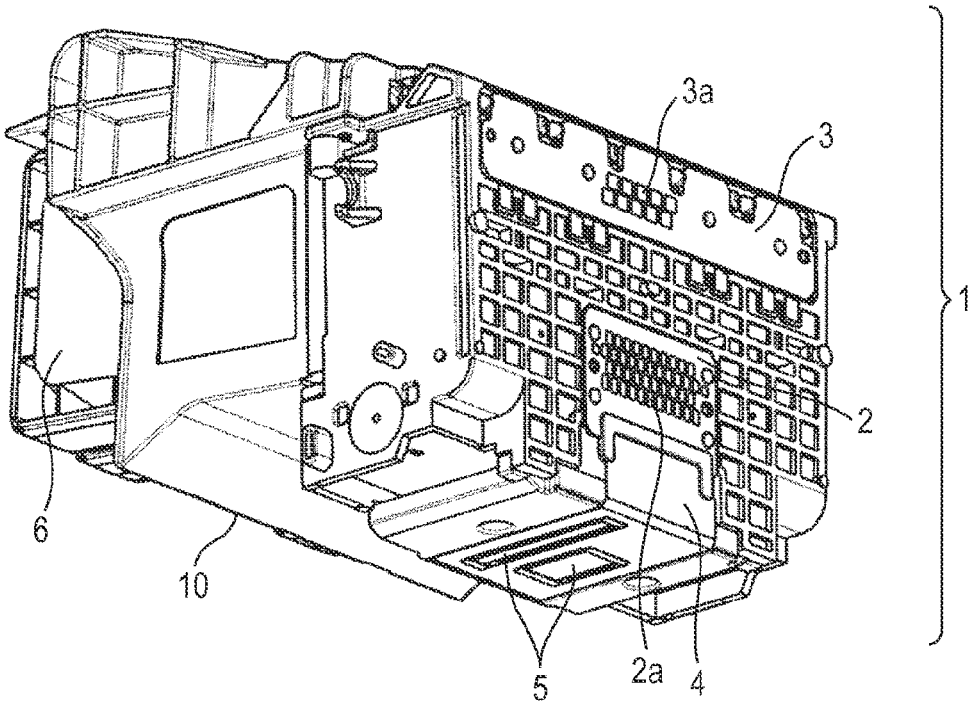
FIG. 1 is a schematic perspective view of an embodiment of liquid ejection cartridge according to the present invention as seen from the bottom side thereof.
Figure 2:
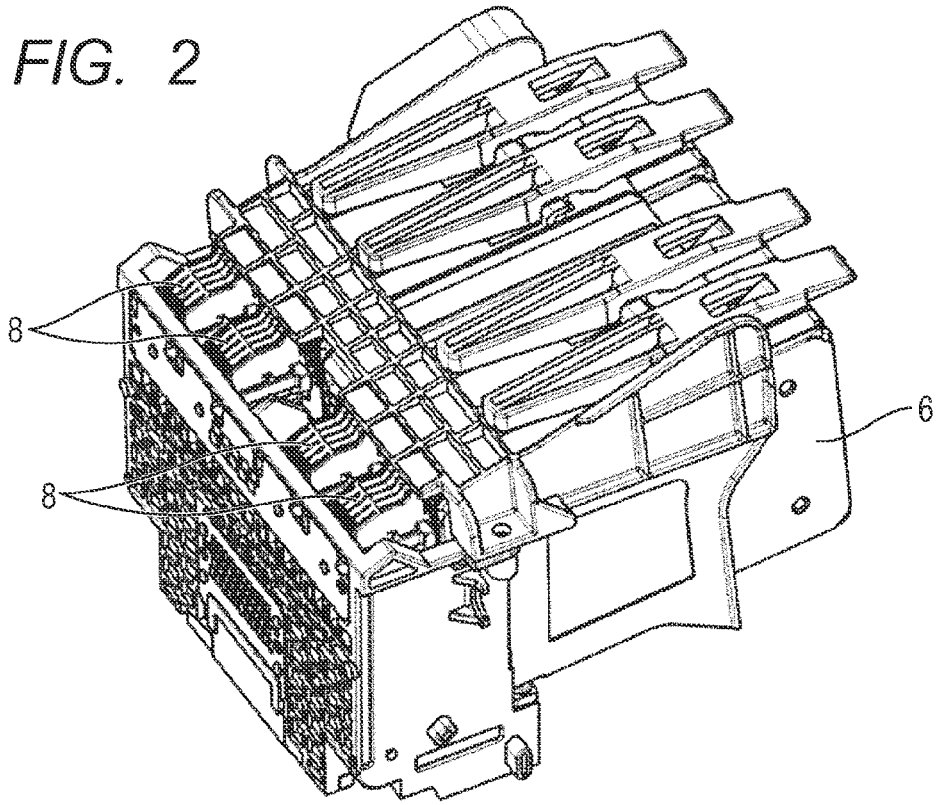
FIG. 2 is a schematic perspective view of the liquid ejection cartridge of FIG. 1 as seen from the top side thereof.

FIGS. 1 and 2 are schematic perspective views of an embodiment of liquid ejection cartridge according to the present invention that is designed to eject liquid such as ink. FIG. 1 is a perspective view of the liquid ejection cartridge as seen from the bottom side (liquid ejection surface side) thereof and FIG. 2 is a perspective view of the liquid ejection cartridge as seen from the top side thereof.

Referring to FIGS. 1 and 2, the liquid ejection cartridge 1 is designed so as to be mounted on the carriage of a liquid ejection apparatus (apparatus main body). The liquid ejection cartridge 1 includes a cabinet 10 having a container section for containing ink tanks 6 (liquid tanks) that are filled with liquid such as ink. More specifically, the liquid ejection cartridge 1 is designed so as to be removably mounted on the carriage. The cabinet 10 has a frame body construction and the ink tanks 6 can removably be mounted in the container section that is arranged in the frame body.

Two recording element substrates 5 are arranged at the bottom surface of the cabinet 10 to form a liquid ejection section. Note, however, that the number of recording element substrates is not limited to two and more or less than two recording element substrates 5 may appropriately be provided according to the specification of the liquid ejection section. For example, only a single recording element substrate 5 may be provided or, alternatively, three or more than three recording element substrates 5 may be provided. Printed substrates 2 and 3, which are plate-shaped electrical wiring substrates, are arranged to operate as electrical contact section for establishing electrical connections with the apparatus main body on the lateral surface of the cabinet 10 that is designed to face the surface of the carriage where electrical connector pins (a terminal section) are formed. Of the two printed substrates 2 and 3, the printed substrate 2 (the first printed substrate or the first electrical wiring substrate) is arranged at the bottom surface side of the cabinet 10, whereas the printed substrate 3 (the second printed substrate or the second electrical wiring substrate) is arranged at the top surface side of the cabinet 10.

Each of the recording element substrates 5 has a plurality of ejection ports for ejecting liquid such as ink, a plurality of energy generating elements for generating energy necessary for ejecting liquid from the respective ejection ports and a drive circuit for driving the energy generating elements. The recording element substrates 5 are electrically connected to the printed substrate 2 by way of an electrical wiring member 4 that is formed by a flexible film member.

Figure 3:
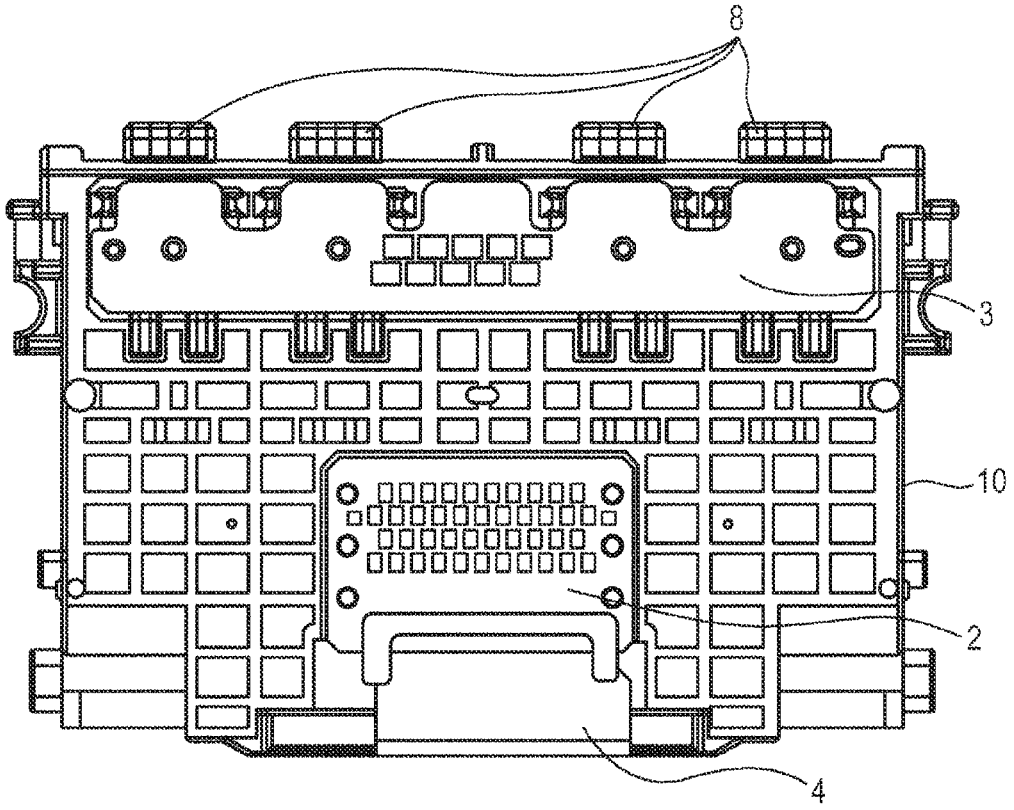
FIG. 3 is a schematic illustration of the surface of the liquid ejection cartridge of FIG. 1 where printed substrates are formed.

The printed substrate 2 transmits signals (including driving signals) to be exchanged between the recording element substrates 5 and the apparatus main body and electric power for driving the recording element substrates 5. The printed substrate 3, on the other hand, transmits signals (other than driving signals) to be exchanged between the ink tanks 6 and the apparatus main body. As illustrated in FIG. 3, the printed substrates 2 and 3 are arranged on a same surface of the cabinet 10.

The printed substrate 2 has a plurality of contact pads 2*a* for supplying driving signals to the recording element substrates 5 from the outside. The carriage is provided with electrical connector pins that correspond to the respective contact pads 2*a* of the printed substrate 2. As the liquid ejection cartridge 1 is mounted on the carriage, the contact pads 2*a* of the printed substrate 2 are electrically brought into contact with the corresponding respective electrical connector pins of the carriage so that driving signals and other signals are supplied from the apparatus main body to the drive circuits of the recording element substrates 5. In each of the recording element substrates 5, the drive circuit thereof drives the energy generating elements that belong to the recording element substrate 5 according to the supplied driving signals.

Figure 4A:
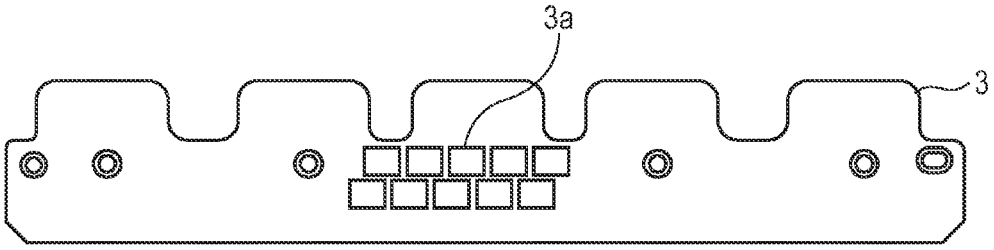
FIG. 4A is a schematic illustration of one of the surfaces of the printed substrate 3 illustrated in FIG. 1.
Figure 4B:
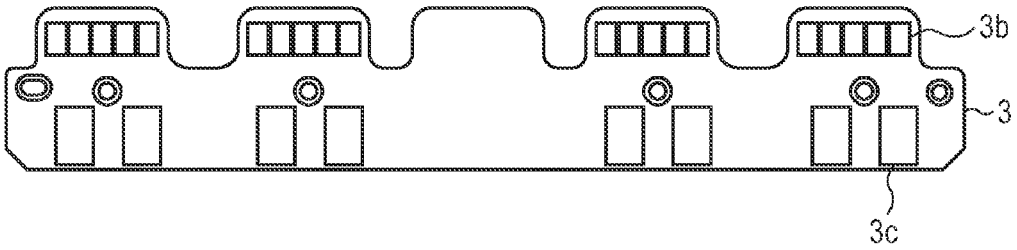
FIG. 4B is a schematic illustration of the other surface of the printed substrate 3 illustrated in FIG. 1.

FIG. 4A is a schematic illustration of one of the surfaces (the carriage side surface) of the printed substrate 3. FIG. 4B is a schematic illustration of the other surface (the surface which faces to the ink tank 6) of the printed substrate 3.

As illustrated in FIG. 4A, a plurality of contact pads 3*a* (the first contact pads) is arranged on one of the surfaces (the carriage side surface) of the printed substrate 3 so as to electrically connect the printed substrate 3 to the apparatus main body. Electrical connector pins that correspond to the respective contact pads 3*a* of the printed substrate 3 are arranged on the carriage. As the liquid ejection cartridge 1 is mounted on the carriage, the contact pads 3*a* of the printed substrate are electrically brought into contact with the corresponding respective electrical connector pins of the carriage. Then, as a result, the printed substrate 3 is electrically connected to the apparatus main body.

As illustrated in FIG. 4B, five contact pads 3*b* (the second contact pads) and two contact pads 3*c* (the third contact pads) are arranged for each of the ink tanks 6 on the other surface (the surface which faces to the ink tanks 6) of the printed substrate 3. These contact pads 3*b* and 3*c* are electrically connected to the contact pads 3*a* by way of wiring, contact holes and so on. The contact pads 3*a* and the contact pads 3*b* and 3*c* are electrically connected such that signals can be exchanged between the ink tanks 6 and the apparatus main body. The region where the plurality of contact pads 3*a* is arranged is smaller than the region where the plurality of contact pads 3*b* is arranged. Note that, while five contact pads 3*b* and two contact pads 3*c* are provided for a single ink tank 6 in the above description, the number of contact pads 3*b* and that of contact pads 3*c* are by no means limited to the above cited ones. In other words, the number of contact pads 3*b* and that of contact pads 3*c* which are provided for a single ink tank 6 may appropriately be selected according to the specification of the liquid ejection section.

Figure 5:
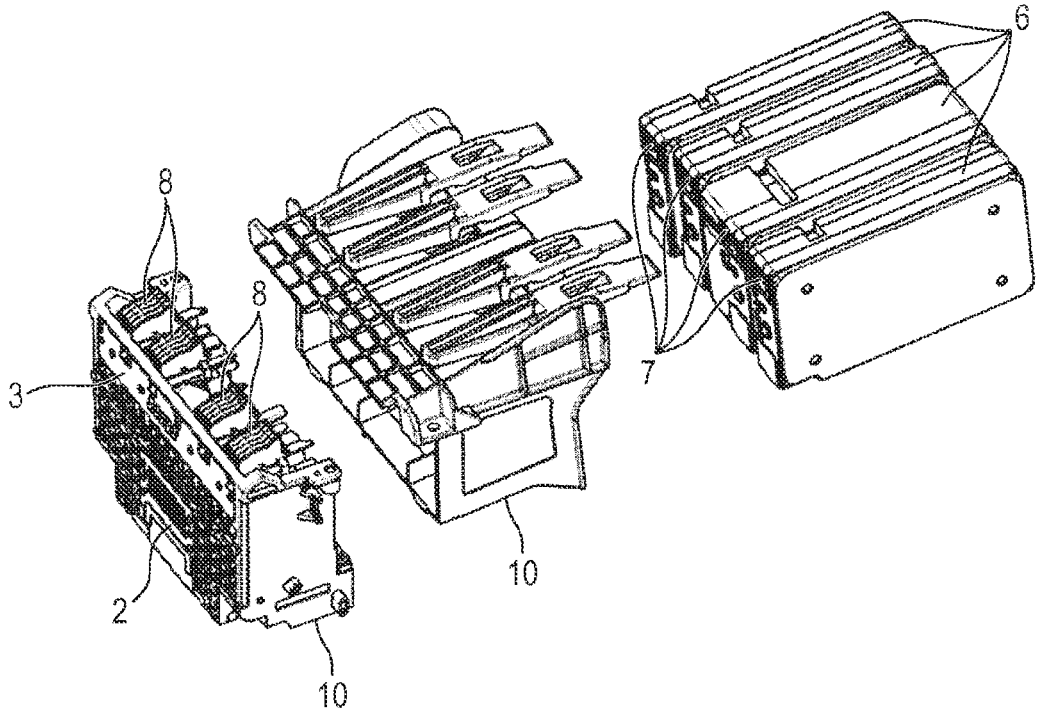
FIG. 5 is an exploded schematic perspective view of the liquid ejection cartridge of FIG. 1.
Figure 6:
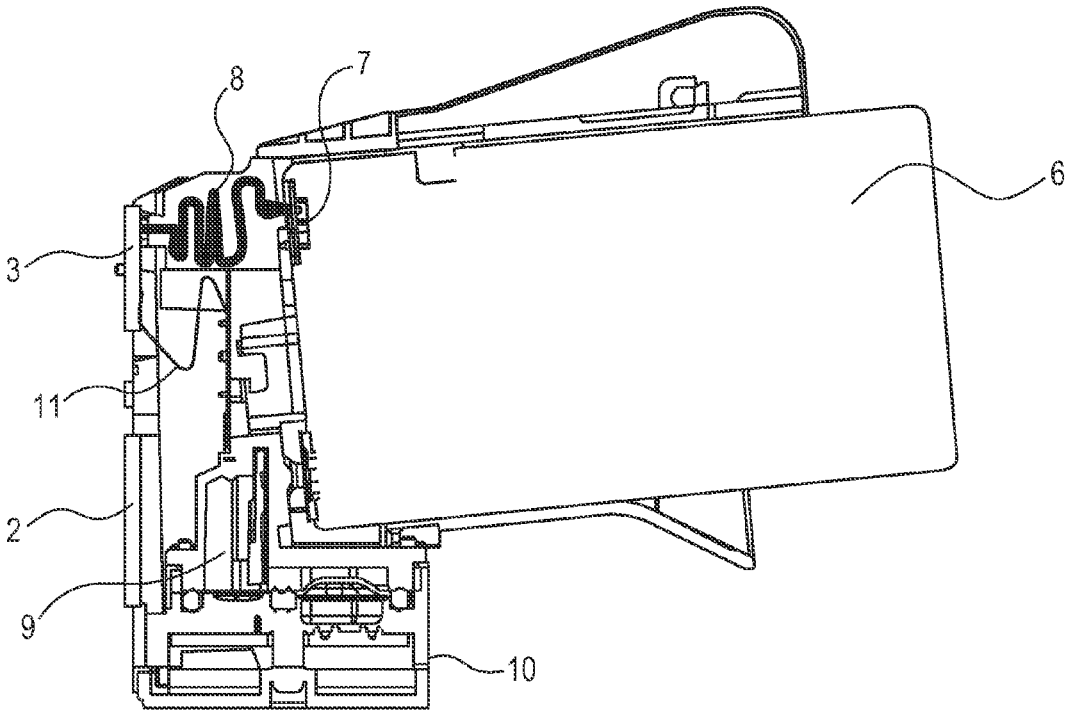
FIG. 6 is a schematic cross-sectional view of the liquid ejection cartridge of FIG. 1.

FIG. 5 is an exploded schematic perspective view of the liquid ejection cartridge 1, illustrating the electrical connection arrangement between the printed substrate 3 and the ink tanks 6. FIG. 6 is a schematic cross-sectional view of the liquid ejection cartridge 1 and an ink tank 6 mounted on the liquid ejection cartridge 1. Now, the electrical connection arrangement between the printed substrate 3 and each of the ink tanks 6 will be described in detail by referring to FIGS. 4B, 5 and 6.

With regard to each of the ink tanks 6, an ink tank information substrate 7 is arranged on the surface of the ink tank 6 at the side thereof where a liquid supply port for leading out ink is disposed. The ink tank information substrate 7 notifies the presence or absence of the ink tank 6 and detects the amount of ink remaining in the inside of the ink tank and if the ink tank 6 is properly mounted or not. The ink tank information substrate 7 then outputs information on the presence or absence of the ink tank 6 and on those detections for the ink tank. As the ink tank 6 is mounted in the cabinet 10 of the liquid ejection cartridge 1, the ink tank information substrate 7 is electrically connected to the corresponding contact pads 3*b* of the printed substrate 3 by way of an ink tank connector 8.

The cabinet 10 of the liquid ejection cartridge 1 is provided with joint members 9 for the respective ink tanks 6. The liquid fed out from each of the ink tanks 6 is then supplied to the recording element substrates 5 by way of the liquid chamber arranged in the related one of the joint members 9. A pair of electrode pins is inserted into the liquid chamber in each of the joint members 9 for the purpose of detecting the presence or absence of ink held in the liquid chamber 9. The electrode pins of each of the joint members 9 are electrically connected to the corresponding contact pads 3*c* of the printed substrate 3 by way of a connector member 11.

As the liquid ejection cartridge 1, in which the ink tanks 6 have already been arranged, is mounted on the carriage, the contact pads 3*a* of the printed substrate 3 are electrically connected to the corresponding respective electrical connector pins of the carriage. As a result, the ink tanks and the apparatus main body can interactively communicate with each other and ink tank information is electrically transmitted from the ink tank information substrates 7 to the apparatus main body. Thus, the apparatus main body can acquire ink tank information signals from the ink tank information substrates 7. Then, the apparatus main body detects the presence or absence of each of the ink tanks 6, the amount of ink remaining in the inside of each of the ink tanks provided that the ink tank is present there, and if each of the ink tanks 6 is properly mounted on the liquid ejection cartridge 1 or not. Additionally, the apparatus main body can detect the presence or absence of ink in each of the ink tanks 6 by supplying a signal to the electrode pins of the liquid chamber in joint member 9 of the ink tank 6.

Once the liquid ejection cartridge 1 is mounted on the carriage, the liquid ejection apparatus is put into a state where it is ready for driving a recording medium such as a sheet of paper to reciprocate in the second direction (the transversal direction of the recording medium) that intersects the first direction, while the apparatus is intermittently or continuously driving the recording medium to move in the first direction. An image is formed on the recording medium as liquid is ejected from the liquid ejection cartridge 1 during such a scanning operation.

In the liquid ejection cartridge 1 of this embodiment, the electrical contact section that is electrically connected to the electrical connector pins (the terminal section) of the carriage is formed by two printed substrates 2 and 3 to provide the following advantages. Now, the advantages of the liquid ejection cartridge 1 of this embodiment will be described below by comparing the electrical contact section of the cartridge with an electrical contact section that is formed by a single printed substrate (comparative example).

A single printed substrate of a size that corresponds to the area extending from the bottom surface side end to the top surface side end of the lateral surface of the cabinet 10 as illustrated in FIG. 3 is employed for the comparative example. On the other hand, the two printed substrates 2 and 3 of this embodiment that are arranged at respective positions in the area extending from the bottom surface side end to the top surface side end of the lateral surface of the cabinet 10 operate same as the single printed substrate of the comparative example for transmitting signals same as the signals that the single printed substrate of the comparative example transmits. Each of the printed substrates 2 and 3 can be made to have an appropriate size and an appropriate shape and the total size of the printed substrates 2 and 3 becomes smaller than the size of the printed substrate of the comparative example as a matter of certainty. Thus, the total size of the printed substrates 2 and 3 of this embodiment can be made smaller than the size of the single printed substrate of the comparative example to make the unit cost of the combined printed substrates 2 and 3 lower than the unit cost of the single printed substrate of the comparative example. Then, as a result, the liquid ejection cartridge 1 can be manufactured at a reduced cost.

The printed substrate 3 is made to represent a profile having a longitudinal direction running in the direction along which the ink tanks 6 are arranged in order to electrically connect itself to the ink tank information substrates 7 of the ink tanks 6 and the connector members 11. On the other hand, the printed substrate 2 is made to have a relatively small size because the printed substrate is only required to accommodate a plurality of contact pads 2*a* to be used for transmissions of driving signals. The contact pads 2*a* are arranged to form a matrix and hence the printed substrate 2 has a substantially square profile. The printed substrate 2 has a length (lateral width) smaller than the length (the lateral width) of the printed substrate 3. Additionally, the aspect ratio of the printed substrate 2 is smaller than the aspect ratio of the printed substrate 3. Because the printed substrate 2 can be adapted to a required size in this way, it can be down-sized to further reduce the unit cost of the printed substrate 2 and hence the unit cost of the combined printed substrates 2 and 3. Note that the lengths (the lateral widths) of the printed substrates 2 and 3 as used herein refer to the lengths thereof in the horizontal direction in a state where the liquid ejection section (the liquid ejection head) is in operation. Since a plurality of ink tanks 6 is mounted in parallel as described above, the liquid ejection cartridge 1 needs to be provided with electrical contact points across the entire width thereof and hence the printed circuit 3 needs to be arranged so as to extend across the entire width of the liquid ejection cartridge 1 in the transversal direction. On the other hand, since the recording element substrates 5 are arranged substantially only in a central part of the liquid ejection cartridge 1, the printed circuit substrate 2 needs to be arranged only in a central part of the liquid ejection cartridge 1. As a result of using separate printed substrates 2 and 3, a size and a position that best meet the required functions of each of the printed substrates 2 and 3 can be selected for the printed substrate 2 and also for the printed substrate 3.

On the lateral surface of the cabinet 10 where the printed substrates 2 and 3 are arranged, the printed substrate 2 is located at a position close to the bottom surface of the cabinet 10 if compared with the printed substrate 3. With this arrangement, the electrical wiring member 4 is allowed to have a relatively short wiring length to reduce the cost and improve the electrical reliability of the electrical wiring member 4.

Furthermore, the printed substrate 3 is located at the top surface side of the lateral surface of the cabinet 10. Then, as a result, the wiring length between the printed substrate 3 and the ink tank information substrates 7 can be curtailed. As separate printed substrates 2 and 3 are employed, if ink leaks out from either or both of the recording element substrates 5 and/or from one or more than one of the ink tanks, the risk of spreading of ink to the electrical contact points of the printed substrates 2 and 3, the recording element substrates 5 and the ink tank information substrates 7 can be minimized.

The printed substrate 3 has a transversally oblong profile as described above. In addition, the stress that arises as the electrical connector pins of the carriage are brought into contact with the printed substrate 3 is applied to the printed substrate 3 from the front surface side. Furthermore, the stress that arises as the ink tank connectors 8 are brought into contact with the printed substrate 3 is additionally applied to the printed substrate 3 from the rear surface side. Therefore, the printed substrate 3 needs to be made to have a thickness that is sufficient to resist the possible deformation of the substrate 3 due to the stresses. On the other hand, only the stress that arises as the electrical connector pins of the carriage are brought into contact with the printed substrate 2 is applied to the printed substrate 2 from the front surface side and the rear surface of the printed substrate 2 is rigidly secured to the mold of the liquid ejection cartridge 1 that is formed as a unit. Therefore, the printed substrate 2 is less liable to be deformed if compared with the printed substrate 3 and therefore can be made to have a thickness that is smaller than the thickness of the printed substrate 3. For instance, the printed substrate 3 is made to represent a thickness of 1.0 mm, whereas the printed substrate 2 is made to represent a thickness of 0.6 mm. As the printed substrate 2 can be made to represent a small thickness, the unit cost of the printed substrate 2 can be further reduced. Additionally, the printed substrate 3 having a relatively large thickness if compared with the thickness of the printed substrate 2 is arranged to extend substantially across the entire width of the liquid ejection cartridge 1 at an upper position as viewed in the gravity direction and hence the printed substrate 3 serves to raise the strength of the liquid ejection cartridge 1. When the liquid ejection cartridge 1 is designed so as to be electrically connected to a plurality of ink tanks as in the case of this embodiment, the printed substrate 3 serves to raise the strength of the liquid ejection cartridge 1 and hence improve the reliability of the electrical connections of the liquid ejection cartridge 1.

Each of the recording element substrates 5 is a semiconductor component that is highly accurately prepared. Therefore, if a high voltage signal that may be produced by static electricity is applied to either of the recording element substrates 5, the circuit thereof may be broken. In the instance of the above cited comparative example, contact pads and wires for transmitting signals to the recording element substrates 5 and contact pads and wires for transmitting signals to the ink tank information substrates 7 etc. are arranged on a single printed substrate in an intermingled manner. With such an arrangement, if any of the contact pads, the wires and the ink tank connectors 8 on the printed substrate is touched by, e.g., a finger, the circuit of the recording element substrate 5 can be broken, if partly, by static electricity. To the contrary, with this embodiment, the printed substrate 2 takes the role of transmitting signals to recording element substrates 5, while the printed substrate 3 takes the role of transmitting signals to the ink tank information substrates 7 etc. and the printed substrate 2 and the printed substrate 3 are insulated from each other. With such an arrangement, if any of the printed substrate 3 and the ink tank connectors 8 is touched by, e.g., a finger, the circuits of the recording element substrates 5 would not be broken by static electricity at all. In this way, possible damages to the electric circuits of the recording element substrates 5 that can be caused by the static electricity generated as a finger touches any of the circuits can be limited to specific parts (the parts of the circuits connected to the printed substrate 2). Thus, when the cabinet of the liquid ejection cartridge is formed by a resin material and two printed substrates are separately arranged in the cabinet as in the instance of this embodiment, the reliability of the liquid ejection cartridge 1 can be improved if compared with the comparative example.

Additionally, in a liquid ejection apparatus including a liquid ejection cartridge 1 of this embodiment, the electrical connector pins for driving signals and the electrical connector pins for ink tank information signals and other signals are formed on a same surface of the cartridge so that the carriage can be formed to represent a simple configuration.

The liquid ejection cartridge 1 and the liquid ejection apparatus are described above only as an example of the present invention and the configurations thereof can be modified appropriately in various different ways.

For example, the level of reliability that is required to the printed substrates may vary from substrate to substrate depending on the type of signals to be transmitted. If such is the case, the electrical contact section of the liquid ejection cartridge 1 may be formed by a plurality of printed substrates that are formed according to respective specifications that are adapted to different types of signals to be transmitted. Then, all the printed substrates are formed on a same surface. In such an instance, the unit cost of each of the printed substrates can be minimized to reduce the cost of the entire liquid ejection cartridge 1.

Alternatively, a plurality of printed substrates may be provided for a single type of signals. For example, the liquid ejection cartridge 1 may be adapted to a line head type recording apparatus and the electrical contact section for establishing electrical contact with the liquid ejection apparatus main body may be formed by a plurality of printed substrates arranged on a same surface. The advantages of such an arrangement will be briefly described below.

A line head is formed by arranging a plurality of recording element substrates in the transversal direction of the recording medium on which an image is to be formed. A liquid ejection apparatus having a line head mounted thereon operates to record an image on the recording medium by driving the line head without any scanning action. When the line head arrangement is compared with the serial head arrangement (with which the liquid ejection head is driven for scanning operations), the former requires an increased member of driving signals because of a large number of recording element substrates the former has so that the number of contact pads to be formed on the printed substrates increases accordingly. If the electrical contact section is formed by a single printed substrate, the printed substrate is required to have a large size because of the large number of contact pads if compared with a serial head.

For the line head arrangement as described above, printed substrates of appropriate respective sizes may be provided for each recording element substrate. The total size of the printed substrates is smaller than the size of the single printed substrate. Then, the unit cost of the combined printed substrates can be reduced to provide a cost down advantage for the liquid ejection cartridge 1.

For the line head arrangement, the plurality of recording element substrates may be divided into two or more than two groups of recording element substrates and each group of recording element substrates may be provided with a printed substrate.

Furthermore, for the liquid ejection cartridge 1 of FIG. 1, each of the recording element substrates 5 may be provided with a printed substrate. Then, as in the instance of the above described line head arrangement, the unit cost of the combined printed substrates can be reduced to provide a cost down advantage for the liquid ejection cartridge 1.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-112192, filed May 30, 2014, which is hereby incorporated by reference herein in its entirety.

What is claimed is:

1. A liquid ejection cartridge comprising:

a liquid ejection section for ejecting liquid, the liquid ejection section having at least a recording element substrate that ejects liquid; and an electrical contact section positioned to be electrically connected to a terminal section of an apparatus main body, the electrical contact section being formed by a plurality of printed substrates including first and second printed substrates arranged on a same surface of the liquid ejection cartridge, wherein the liquid ejection section ejects liquid according to driving signals supplied from the terminal section of the apparatus main body and transmitted by the first printed substrate to the recording element substrate.

2. The liquid ejection cartridge according to claim 1, wherein the second printed substrate transmits signals other than the driving signals.

3. The liquid ejection cartridge according to claim 2, wherein the signals other than the driving signals are signals representing information on a liquid tank for supplying liquid to the liquid ejection section.

4. The liquid ejection cartridge according to claim 3, wherein the horizontal length of the first printed substrate is smaller than the horizontal length of the second printed substrate in a state where the liquid ejection section is in operation.

5. The liquid ejection cartridge according to claim 3, wherein the second printed substrate is provided on one of its surfaces with a first contact pad to be electrically connected to the apparatus main body and on the other surface thereof with a second contact pad to be electrically connected to the liquid tank.

6. The liquid ejection cartridge according to claim 2, wherein the recording element substrate is arranged on the bottom surface of the liquid ejection cartridge and the first printed substrate is arranged at a position close to the bottom surface relative to the position where the second printed substrate is arranged on the same surface.

7. The liquid ejection cartridge according to claim 2, wherein the thickness of the first printed substrate is smaller than the thickness of the second printed substrate.

8. A liquid ejection apparatus comprising:

a liquid ejection cartridge according to claim 1; and a carriage carrying the liquid ejection cartridge mounted thereon;

the carriage having a plurality of electrical connector pins to be electrically connected to the electrical contact section of the liquid ejection cartridge.

9. A liquid ejection cartridge comprising:

a cabinet having a container section for containing a liquid tank which contains liquid therein;

a recording element substrate arranged on a first surface of the cabinet to eject liquid;

a connector arranged in the container section;

a first electrical wiring substrate arranged on a second surface of the cabinet so as to be electrically connected to the recording element substrate; and a second electrical wiring substrate arranged on the second surface so as to be electrically connected to the connector.

10. The liquid ejection cartridge according to claim 9, wherein the aspect ratio of the second electrical wiring substrate is greater than the aspect ratio of the first electrical wiring substrate.

11. The liquid ejection cartridge according to claim 9, wherein the first electrical wiring substrate and the second electrical wiring substrate are plate-shaped printed substrates.

12. The liquid ejection cartridge according to claim 9, wherein the second electrical wiring substrate is located above the first electrical wiring substrate as viewed in the gravity direction in a state where the liquid ejection cartridge is in operation.

13. The liquid ejection cartridge according to claim 9, wherein a first contact pad to be electrically connected to the outside is provided on one of the surfaces of the second electrical wiring substrate and a second contact pad to be electrically connected to the connector is provided on the rear surface of the second electrical wiring substrate.

14. The liquid ejection cartridge according to claim 13, wherein the region of the second electrical wiring substrate where the first contact pad is arranged is smaller than the region of the second electrical wiring substrate where the second contact pad is arranged.

15. The liquid ejection cartridge according to claim 9, wherein the cabinet has a frame body construction and the connector is arranged in the frame.

16. The liquid ejection cartridge according to claim 15, wherein the container section is arranged in the frame.

17. The liquid ejection cartridge according to claim 9, wherein the recording element substrate and the first electrical wiring substrate are electrically connected to each other by a flexible electrical wiring member.

18. The liquid ejection cartridge according to claim 9, further comprising:

a liquid chamber for holding liquid therein and electrode pins arranged in the liquid chamber.

19. The liquid ejection cartridge according to claim 18, wherein the second electrical wiring substrate is provided on the rear surface with a third contact pad to be electrically connected to the electrode pins.

20. A liquid ejection apparatus comprising:

a liquid ejection cartridge according to claim 9; and a carriage carrying the liquid ejection cartridge mounted thereon;

the carriage having a plurality of electrical connector pins to be electrically connected to the first and second electrical wiring substrates of the liquid ejection cartridge.

* * * * *